US005263599A

United States Patent [19]

Sklar

[11] Patent Number: 5,263,599

[45] Date of Patent: Nov. 23, 1993

[54] INFANT NURSING DEVICE

[76] Inventor: Jeffrey S. Sklar, 9 Brooks Rd., Wayland, Mass. 01778

[21] Appl. No.: 844,836

[22] Filed: Mar. 3, 1992

[51] Int. Cl.[5] ..... A61J 9/00

[52] U.S. Cl. ..... 215/11.1; 215/365

[58] Field of Search ..... 215/365, 11.1, 11.2, 215/11.4, 11.5, 11.6

[56] References Cited

U.S. PATENT DOCUMENTS

| | | | |
|---|---|---|---|
| 388,677 | 8/1888 | Hayes | 215/365 X |
| 2,514,744 | 7/1950 | Cipyak | 215/11.1 |
| 3,028,983 | 4/1962 | Barr | 215/365 |
| 3,077,279 | 2/1963 | Mitchell | 215/11.1 |
| 3,139,064 | 6/1964 | Harle | 215/11.1 X |
| 3,567,059 | 3/1971 | Littman | 215/11.2 |
| 3,645,413 | 2/1972 | Mitchell | 215/11.1 |
| 3,790,016 | 2/1974 | Kron | 215/11.1 |

FOREIGN PATENT DOCUMENTS

| | | | |
|---|---|---|---|
| 456160 | 11/1991 | European Pat. Off. | 215/11.1 |
| 3145598 | 5/1983 | Fed. Rep. of Germany | 215/11.1 |
| 1020296 | 2/1953 | France | 215/365 |
| 2576686 | 8/1986 | France | 215/11.1 |
| 60310 | 1/1939 | Norway | 215/365 |
| 422394 | 1/1935 | United Kingdom | 215/365 |

*Primary Examiner*—Sue A. Weaver

*Attorney, Agent, or Firm*—Pandiscio & Pandiscio

[57] ABSTRACT

A device useful in the feeding of infants is provided which includes an at least partially transparent or transluscent container having an open mouth centered on its longitudinal axis at its top end, and a nipple removably attached to the top end of the container so as to cover and protrude from the open mouth thereof. Graduated markings are provided on the container in spaced relation to the open mouth which are located, respectively, in selected sloping, non-parallel planes which are (1) normal to a first vertical plane containing the longitudinal axis of the container, (2) intersect at an acute angle a second vertical plane containing the longitudinal axis of the container and which is located normal to the first vertical plane, and (3) do not intersect each other within the volume defined by the container. The sloping planes are selected such that the markings contained therein provide indications of the liquid remaining in the container as the container is tipped upward from a partially inverted feeding position toward a fully inverted (i.e., vertical) position during normal infant feeding.

15 Claims, 5 Drawing Sheets

INFANT NURSING DEVICE

FIELD OF THE INVENTION

The present invention relates generally to infant nursing devices, and more particularly to an infant nursing bottle and nipple combination wherein means are provided for easily, conveniently and accurately reading the quantity of liquid remaining in the bottle while the bottle is semi-inverted during infant feeding.

BACKGROUND OF THE INVENTION

In bottle feeding an infant, care must be taken to ensure that the bottle's nipple constantly remains full of liquid in order to prevent colic or distress to the infant due to the ingestion of air during the nursing process. Accordingly, during bottle feeding, the bottle is customarily held in a semi-inverted, nipple-down position so that the fluid will fill the nipple and any air in the bottle will retreat to the opposite end of the bottle. The angle at which the bottle is held, and to some extent the angle of the infant's head as well, tends to vary during the feeding process in order to ensure the continuous presentation of a full nipple to the infant.

More specifically, at the start of feeding, when the bottle is substantially full of liquid, the infant's head is typically tilted upward at an angle to prevent choking and for improved peristalsis, while the bottle is held with its longitudinal axis inclined at a small upward angle so that the nipple resides below the opposite end of the bottle. Since the bottle is at its fullest, and hence heaviest, at this point in the feeding process, this position tends to be the most comfortable for the individual feeding the infant. At the same time, however, since there is relatively little air in the bottle at this point, there is little chance of the infant ingesting air with this almost-horizontal bottle orientation.

As the feeding progesses, however, the ratio of air to liquid in the bottle increases. As a result, in order to avoid unintended ingestion of air from the bottle, the bottle's angle of inclination must gradually be increased, while the angle of inclination of the infant's head is gradually decreased, so as to ensure that only fluid will be ingested by the infant. This process continues until, at the conclusion of feeding, the bottle generally approaches a substantially vertical, fully-inverted orientation, while the infant's head generally approaches a substantially horizontal orientation.

It has also been found desirable to monitor the amount of liquid remaining in the bottle during the feeding process. This enables the individual feeding the infant to maintain control over the amount and rate of liquid ingested by the infant, and to know if the baby is actively feeding or if it is just pacifying itself on the nipple. This can be of particular interest when evaluating a new nipple to determine if the nipple hole size is appropriate or, when enlarging an existing nipple hole, to determine if the nipple hole size has been enlarged enough.

To this end, traditional nursing bottles frequently have graduated markings disposed on the side of the bottle to indicate the volume of liquid contained in the bottle. These graduated markings traditionally extend parallel to the bottom of the bottle and are sequentially numbered, with the lowest number set at the bottom end of the bottle (i.e., at the end opposite the nipple) and the highest number set at the top end of the bottle (i.e., at the end adjacent the nipple). In this way such bottles can be set upright and the amount of fluid remaining in the bottle read by simply comparing the meniscus of the fluid to the graduated markings.

Unfortunately, such bottles require that the individual feeding the infant periodically interrupt the infant's feeding and return the bottle to its upright position in order to determine the amount of fluid remaining in the bottle. Such interruptions of the infant's feeding are, of course, undesirable, particularly since it is often difficult or impossible to make the infant resume feeding thereafter.

See, for example, U.S. Pat. No. 3,332,563. Similar arrangements for other types of containers are shown in U.S. Pat. Nos. 1,203,448 and 3,645,413.

To solve this problem, it has been suggested that traditional nursing bottle be provided with markings located in parallel, downwardly slanted planes extending through the bottle. These markings can be provided either alone (as shown in U.S. Design Pat. No. 167,914), or in combination with a nipple having an oblong cross-section, the major transverse axis of which is located parallel to the planes containing the graduated markings on the bottle (as shown in U.S. Pat. No. Re. 25,247).

Similarly, it has been suggested in U.S. Pat. No. 2,514,744 that a bottle be provided which is adapted to be placed on its side such that its longitudinal axis extends at a small angle to the horizontal, and which has an open mouth positioned at the lower end of the bottle which faces downward when the bottle is so positioned. The liquid-containing chamber of this bottle is configured in such a way that a nipple attached to the open mouth of the bottle will remain full of fluid throughout the feeding process, without any tipping of the bottle. Parallel graduated markings are provided on the side of this bottle for measuring the amount of liquid remaining in the bottle during feeding.

Furthermore, means have been proposed for monitoring the fluid flow through a nipple, such as those shown in U.S. Pat. No. 3,790,016.

Unfortunately, none of the foregoing arrangements has proven to be totally satisfactory.

Slanted parallel markings positioned on the side of a traditional nursing bottle (e.g. as in the case of U.S. Design Pat. No. 167,914 or U.S. Pat. No. Re. 25,247) generally do not provide helpful or convenient indications of the amount of fluid remaining in the bottle during feeding, since they assume a generally constant bottle orientation during feeding. Unfortunately, however, as noted above, in practice the bottle's angle of orientation tends to vary during feeding, with the bottle's nipple being gradually tipped further and further downward until the bottle reaches a substantially vertical orientation. Thus, providing a plurality of parallel slanted markings on the exterior of the bottle cannot provide accurate indications of the amount of fluid remaining in the bottle over the wide range of bottle orientations encountered in feeding.

The bottle of U.S. Pat. No. 2,514,744 is designed primarily for use in the situation where the bottle is placed on a flat surface, with the nipple overhanging an edge thereof, so that an infant may take the nipple in its mouth and nurse, without the bottle being held by an individual. Such unattended nursing is generally not preferred; an adjacent overhanging edge may not be conveniently available; and the configuration of the bottle is generally uncomfortable for traditional feeding.

Finally, fluid monitoring devices are generally relatively expensive, cumbersome, and subject to malfunction if not carefully maintained.

U.S. Pat. No. 388,677 discloses an open mouthed container with measurement lines which radiate outwardly from the pouring point of the container. These lines are located such that as the container is rotated to allow the liquid contained therein to spill out over the pouring point, a means is provided for determining the quantity of liquid remaining in the container without interrupting the pouring operation or returning the container to its upright position.

It must be appreciated, however, that the act of pouring fluid out of an open-topped bottle is substantially different from the act of infant feeding with a nipple-topped bottle. Specifically, in pouring one always wants air to be able to enter the container continuously through the container's open mouth, above the liquid stream flowing out of the container. If this does not occur, the liquid will not flow smoothly and continuously out of the container. Conversely, however, in bottle feeding, one always wants the nipple and the open mouth of the bottle to remain full of liquid so as to ensure that only liquid is ingested by the infant. Accordingly, with many infant bottles air is introduced into the bottle to replace the liquid consumed by the infant through small, one-way valves located at the base of the nipple so that the air will bubble upwardly through the liquid in the semi-inverted container. Alternatively, some infant bottles place the liquid in a flexible inner pouch which can contract in volume as the fluid is removed, so that no air need be introduced into the pouch as the fluid is removed. In either case the goal is the same; to provide means by which feeding can occur while the nipple is kept continuously full of fluid.

Thus it will be appreciated that, inasmuch as an air gap would always be presented at the open mouth of a container such as that taught in U.S. Pat. No. 388,677, such a container is not applicable for use in a bottle feeding context.

Still other fluid level indicators for containers are shown in U.S. Pat. Nos. 3,077,279 and 4,293,084. However, such arrangements are not believed to be satisfactory for use in continuously monitoring the fluid level in a baby bottle during the typical feeding process discussed above.

OBJECTS AND SUMMARY OF THE PRESENT INVENTION

Accordingly, one object of the present invention is to provide an infant nursing device which will enable the individual feeding the infant to easily, conveniently and accurately determine the quantity of liquid remaining in the device at any time during the feeding process and while the device is disposed in its semi-inverted feeding position.

Another object of the present invention is to provide an infant nursing bottle and nipple combination wherein the bottle includes a plurality of graduated markings thereon, wherein each of the graduated markings is positioned and configured so as to accurately reflect the current volume of fluid in the bottle given the normal or typical orientation of the bottle for that particular fluid level.

Still another object of the present invention is to provide markings on the bottle which will help an inexperienced feeder recognize and achieve the preferred orientation of the bottle for a given fluid level, so as to ensure that no air is ingested by the infant as it is being fed.

Yet another object of the present invention is to provide graduated markings on the bottle which will show the quantity of fluid remaining in the bottle during feeding, wherein the markings can be applied to standard baby bottles without requiring modification of the size, nipple or nipple collar of such standard baby bottles.

And another object of the present invention is to provide a way of placing graduated markings on a baby bottle which will show the quantity of fluid remaining in the bottle during feeding, wherein the markings can be applied to baby bottles having a variety of different cross-sectional shapes.

The present invention proceeds from the discovery that, for any conventional bottle/nipple configuration, most individuals tend to hold the bottle substantially the same way (i.e., at substantially the same angle of orientation) as other individuals, for a given quantity of liquid in the bottle. This is a significant discovery because it allows a bottle/nipple combination to be provided which includes graduated markings on the bottle which are adapted and positioned so that they take into account the changing inclination of the bottle during the feeding process. As a result, the graduated markings are indicative of the quantity of liquid remaining in the bottle at any time during the feeding process, with the markings being readable during feeding and without requiring that the bottle be removed from the infant's mouth.

More specifically, the invention includes a bottle-like container adapted to hold liquid, and nipple means. The container has a top end, a bottom end, a longitudinal axis, and an open mouth at the top end substantially centered about the longitudinal axis. The container includes at least one portion, extending from a point substantially adjacent to the top open mouth of the container down to the bottom end of the container, which is non-opaque. A plurality of graduated markings are located on the container in spaced relation to its top end. In the preferred case, the container is either transparent or translucent and the graduated markings extend entirely around the container, with each graduated marking having a planar configuration that corresponds to the cross-section of the container at the location of that graduated marking.

Each of the graduated markings is located in a selected sloping plane (a) which is normal to a first plane which contains the longitudinal axis, (b) which intersects at an acute angle a second plane containing the longitudinal axis and located normal to the first plane, and (c) which does not intersect any other sloping plane within the volume of the container. The planes containing the graduated markings are selected such that the graduated markings are always indicative of the amount of fluid remaining in the container as it is raised from its partially inverted starting position toward a fully inverted ending position as the infant feeds.

It is contemplated that the planes containing the graduated markings may intersect one another at a common point or line segment on the outer surface of the container, or they may intersect one another at a common line located at a distance from the container, or they may intersect one another at a plurality of lines located at a distance from the container, all without departure from the present invention.

The graduated markings are disposed on the bottle so that their respective planes intersect the aforementioned second plane in a progressive series of angles, with the plane of the graduated marking nearest the nipple end of the bottle intersecting the aforementioned second plane at an angle closer to the perpendicular than the plane of the graduated marking nearest the opposite end of the bottle, and with the planes of the graduated markings disposed therebetween intersecting the aforementioned second plane progressively closer and closer to the perpendicular as they approach the nipple end of the bottle.

The nipple means includes a nipple and a collar such that the nipple is placed over the open mouth of the container and secured thereto by the collar. This attachment may be accomplished by a snap fit, a threaded engagement of the collar with the container adjacent the open mouth, or any other convenient means.

BRIEF DESCRIPTION OF THE DRAWINGS

These and other objects and features of the present invention will be more fully disclosed or rendered obvious by the following detailed description of the preferred embodiments of the invention, which is to be considered together with the accompanying drawings wherein like numbers refer to like parts and further wherein.

DETAILED DESCRIPTION OF THE INVENTION

Figure 1:
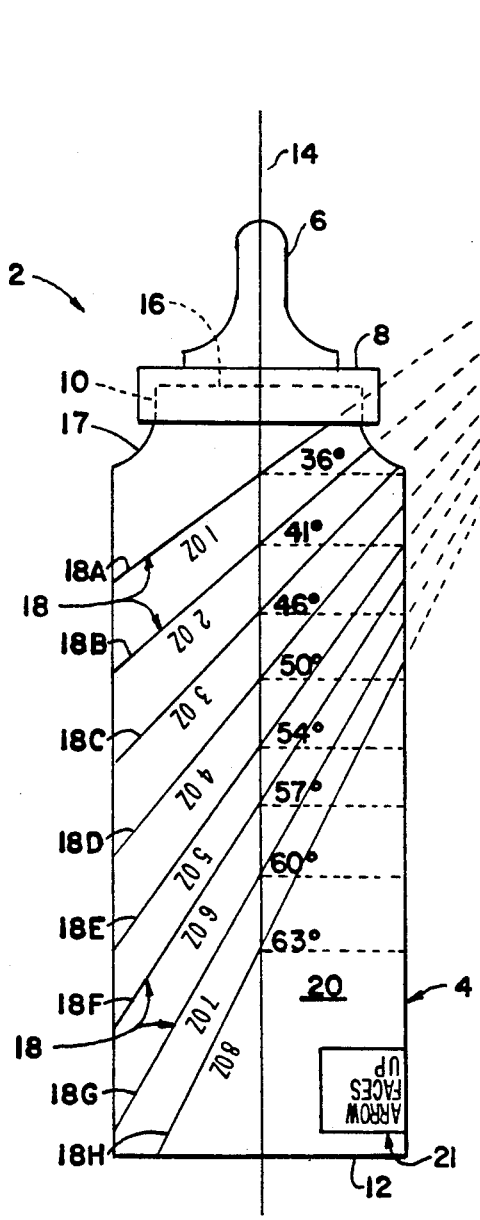
FIG. 1 is an illustrative side elevational view of an infant nursing device made in accordance with the present invention, wherein the graduated markings have been placed on the container in accordance with empirically derived locations therefor, and wherein the planes containing the graduated markings intersect each other at a plurality of parallel lines which are located at a distance from the container.
Figure 1A:
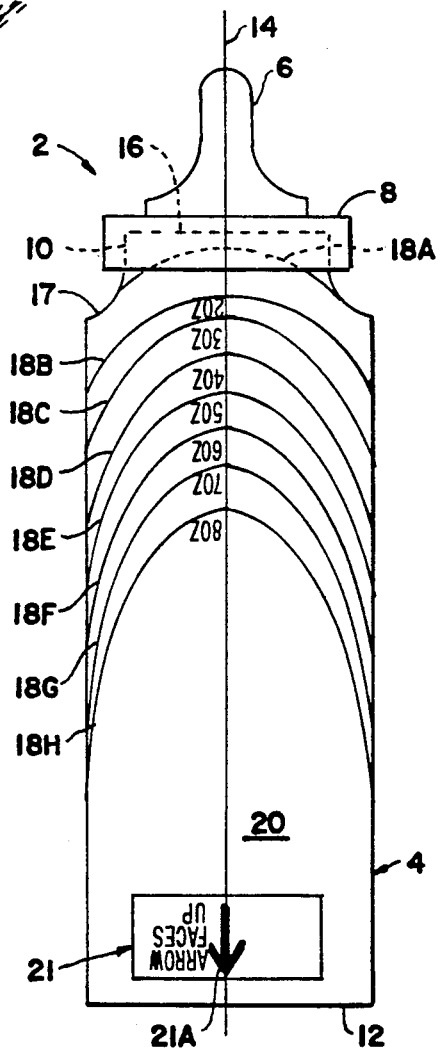
FIG. 1A is a side elevational view of the same bottle, with the bottle having been rotated 90 degrees about its longitudinal axis from the position shown in FIG. 1.

Referring now to the drawings, and particularly to FIGS. 1 and 1A, there is shown an infant nursing device 2 formed in accordance with the present invention. Device 2 generally includes a bottle or container 4, a nipple 6, and a mounting collar 8.

Container 4 has a top end 10, a bottom end 12, a longitudinal axis 14, and an open mouth 16 positioned at its top end 10. Container 4 generally has a somewhat narrower diameter at its top end 10 than at its bottom end 12, so as to provide a neck or throat section 17. In the preferred embodiments, the container 4 is either transparent or transluscent so that the level of liquid contained therein is easily viewed from outside the container. It should be understood, however, that the purposes of the invention may be achieved in its broadest aspects if only a portion of the container extending from a point substantially adjacent to the top open mouth 16 to the bottom end 12 is non-opaque.

Nipple 6 is removably attached to container 4 in a conventional manner by collar 8. Specifically, nipple 6 covers the open mouth 16 of the container and projects outwardly therefrom, and collar 8 grasps nipple 6 while it engages the container adjacent to top end 10. As is well known in the art, the engagement of collar 8 with container 4 may be a snap fit, a threaded engagement, or any other convenient means of secure yet removable attachment.

A plurality of graduated markings 18 (e.g. 18A, 18B, 18C, 18D, 18E, 18F, 18G and 18H) are located on container 4. Markings 18 may be placed on the container by painting, etching, stickers or some other convenient means, or they may be formed integrally with the container, for example as ridges or grooves on its outer surface 20. Furthermore, legends or other written indicia are preferably associated with each graduated marking so as to facilitate the reading of measurements of the liquid remaining in the container at any given time. See, for example, FIGS. 1 and 1A, wherein each of the graduated markings 18A, 18B, 18C, etc. has a corresponding indicia marking (i.e., "1 oz", "2 oz", "3 oz", etc.) associated with it. It is to be appreciated that where such indicia markings are provided, the indicia associated with graduated marking 18A (i.e., the graduated marking closest to nipple 6) will have a lower value than the indicia associated with graduated marking 18H (i.e., the marking closest to bottle end 12). This is because the indicia are intended to be read while the bottle is semi-inverted for feeding, so that graduated marking 18A will relate to a lower fluid level than graduated marking 18H.

Bottle 4 also preferably includes direction marking means 21 (FIG. 1A) for indicating which portion of the bottle is to face upward during use, as will hereinafter be discussed in further detail. Direction marking means 21 preferably comprises an arrow 21A positioned adjacent to and pointing towards the bottle's bottom end 12. Direction marking means 21 will appear on the "line" formed by connecting the point on each marking 18 which lies closest to nipple 6, i.e., direction marking means 21 will appear on the "first vertical plane" as hereinafter discussed.

It will also be appreciated that as many, or as few, graduated markings 18 may be provided on bottle 4 as desired. Thus, for example, for a standard 9 oz nursing bottle, 8 graduated markings 18 might be provided to show the 1 oz–8 oz fluid levels for the bottle.

In the embodiment shown in FIG. 1, bottle or container 4 preferably has a substantially circular cross-section, and each of the graduated markings 18A, 18B, 18C, etc. extends completely around the bottle, so that graduated markings 18A, 18B, 18C, etc. comprise a series of ellipses located in spaced relation along the bottle. Of course, any graduated markings 18 positioned on the bottle's neck 17 may vary slightly from a true ellipse, due to the transitional nature of the bottle's neck portion 17. Furthermore, it will also be appreciated that bottle 4 may also be formed with a different cross-section, in which case graduated markings 18A, 18B, 18C, etc. will assume a different shape, as will hereinafter be discussed in further detail.

Each of the graduated markings 18A, 18B, 18C, etc. is located in a selected sloping plane (a) which is normal to a first vertical plane which contains the longitudinal axis 14, and (b) which intersects at an acute angle a second vertical plane containing the longitudinal axis 14 and located normal to the first vertical plane. By way of reference, in the context of the page containing FIG. 1, the aforementioned first vertical plane would be the plane of the page itself, and the second vertical plane would be the plane containing the longitudinal axis 14 and extending perpendicular to the plane of the page.

It is an essential feature of the present invention that the graduated markings 18A, 18B, 18C, etc. be positioned on bottle 4 such that their respective planes extend non-parallel to one another. Such a non-parallel configuration is critical if the graduated markings 18A, 18B, 18C, etc. are to accurately reflect the volume of fluid in the bottle over the wide range of different bottle orientations presented during feeding.

Furthermore, the graduated markings 18A, 18B, 18C, etc. must be disposed on bottle 4 so that their respective planes intersect the aforementioned second plane in a progressive series of angles, with the plane of graduated marking 18A (i.e., the graduated marking positioned closest to nipple 6) intersecting the aforementioned second plane at an angle closer to the perpendicular than the plane of graduated marking 18H (i.e., the graduated marking positioned closest to the bottle's end 12). In addition, the planes of the graduated markings disposed between graduated markings 18A and 18H intersect the aforementioned second plane progressively closer and closer to the perpendicular as they progress from graduated marking 18H toward graduated marking 18A. Stated another way, progressing from the bottle's top end 10 to its bottom end 12, the plane of each successive graduated marking 18 is set at a greater angle to the perpendicular than the plane of the preceding graduated marking. Again, such a progressive series of angles is critical if the graduated markings 18A, 18B, 18C, etc. are to accurately reflect the volume of fluid in the bottle over the wide range of different bottle orientations presented during feeding.

If desired, graduated markings 18 may be placed on bottle 4 so that the degreee of progression between the angles of adjacent graduated markings 18 is approximately constant along the length of the bottle. In other words, graduated markings 18 may be placed on bottle 4 so that the rate of change between the angles of adjacent graduated markings 18 is constant. Thus, for example, with such an arrangement, if graduated marking 18H were set at an angle of X degrees relative to a plane extending perpendicular to the first and second vertical planes described above, and marking 18G were set at an angle of (X-3) degrees relative to a plane extending perpendicular to the first and second vertical planes described above, each succeeding marking 18 would be set at an angle 3 degrees less than its preceding marking 18, as one progresses from the bottle's bottom end 12 to its top end 10.

More preferably, however, graduated markings 18 are placed on bottle 4 so that the degree of progression between the angles of adjacent graduated markings 18 increases as they approach nipple 6. In other words, graduated markings 18 are placed on bottle 4 so that the rate of change between the angles of adjacent graduated markings 18 increases as they approach nipple 6. This increase in the rate of change between the angles of adjacent graduated markings 18 can be fairly linear along the length of the bottle, or it can occur as a series of discrete steps. Thus, for example, if graduated marking 18H were set at an angle of X degrees relative to a plane extending perpendicular to the first and second vertical planes described above, and marking 18G were set at an angle of (X-3) degrees relative to a plane extending perpendicular to the first and second vertical planes described above, marking 18F might be set at an angle of (X-6) degrees relative to a plane extending perpendicular to the first and second vertical planes described above, marking 18E might be set at an angle of (X-10) degrees relative to a plane extending perpendicular to the first and second vertical planes described above, marking 18D might be set at an angle of (X-14) degrees relative to a plane extending perpendicular to the first and second vertical planes described above, marking 18C might be set at an angle of (X-19) degrees relative to a plane extending perpendicular to the first and second vertical planes described above, marking 18B might be set at an angle of (X-24) degrees relative to a plane extending perpendicular to the first and second vertical planes described above, and marking 18A might be set at an angle of (X-30) degrees relative to a plane extending perpendicular to the first and second vertical planes described above. Obviously other rates of increasing progression may be substituted where desired.

In the empirically derived embodiment depicted in FIG. 1, the planes containing the various graduated markings 18A, 18B, 18C, etc. are spaced from each other along longitudinal axis 14, and form acute angles of approximately 36, 41, 46, 50, 54, 57, 60, and 63 degrees, respectively, with a plane extending perpendicular to the first and second vertical planes described above. These angles, and the spacing between the various graduated markings 18, were found empirically to represent, for a variety of experienced feeders, the average location of the meniscus for the 1 oz, 2 oz, 3 oz, 4 oz, 5 oz, 6 oz, 7 oz and 8 oz fluid levels in a "standard" 9 oz nursing bottle, i.e., one approximately 6 inches tall and 2.25 inches in diameter in the region below its throat section 17.

It is to be appreciated that, while the foregoing angles represent the "average" angles empirically determined for the group sampled, a close correlation was found to exist among substantially all of the individuals who have been tested to date. This suggests that in the feeding of infants, most experienced individuals tend to adopt substantially the same angles of bottle inclination for a given fluid level, and that they tend to vary those angles during the course of feeding in substantially the same way. This finding makes sense when one considers that the individuals all start with the same quantity of fluid in a bottle held nearly horizontal, and all end with the same quantity of fluid in a bottle held nearly vertical, and tend to smoothly tip the bottle progressively further and further upward during feeding. Accordingly, it will be seen that standardized graduation markings may be positioned on the container so as to provide, for substantially all users, a reliable measurement of the liquid remaining in the container at any given time during feeding, without requiring removal of the nipple from the infant's mouth.

It is to be appreciated that, as shown in FIG. 1, the empirically derived graduated markings 18A, 18B, 18C, etc. "intersect" one another at a plurality of "points" located at a distance from the bottle; or, more accurately, the planes defined by the graduated markings 18A, 18B, 18C, etc. intersect one another at a plurality of lines located at a distance from the bottle, with these lines extending parallel to one another.

Figure 1B:
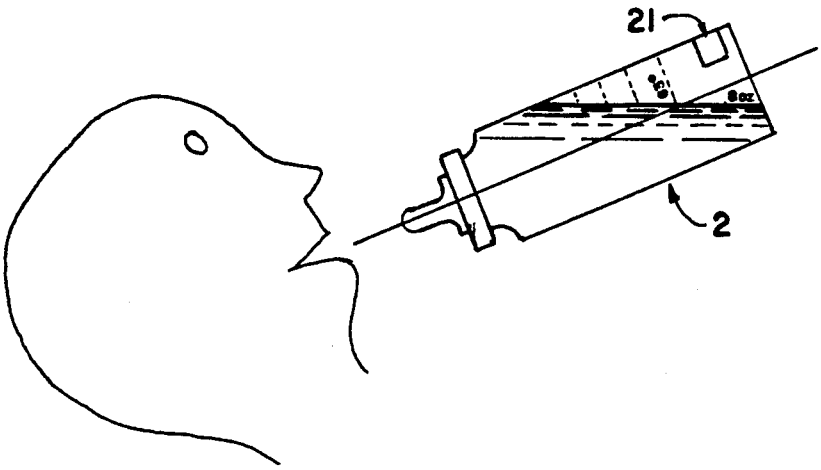
FIGS. 1B–1D are side elevational views of the same bottle, with the bottle being shown in various stages of feeding.
Figure 1C:
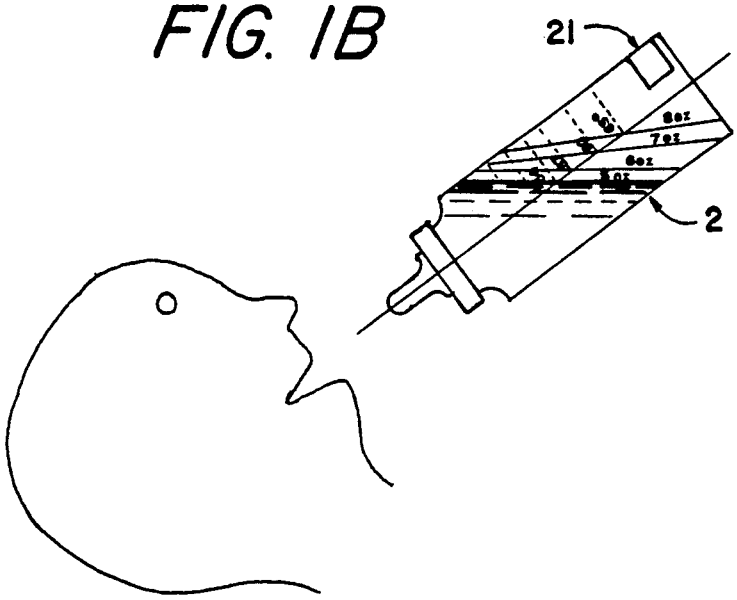
Figure 1D:
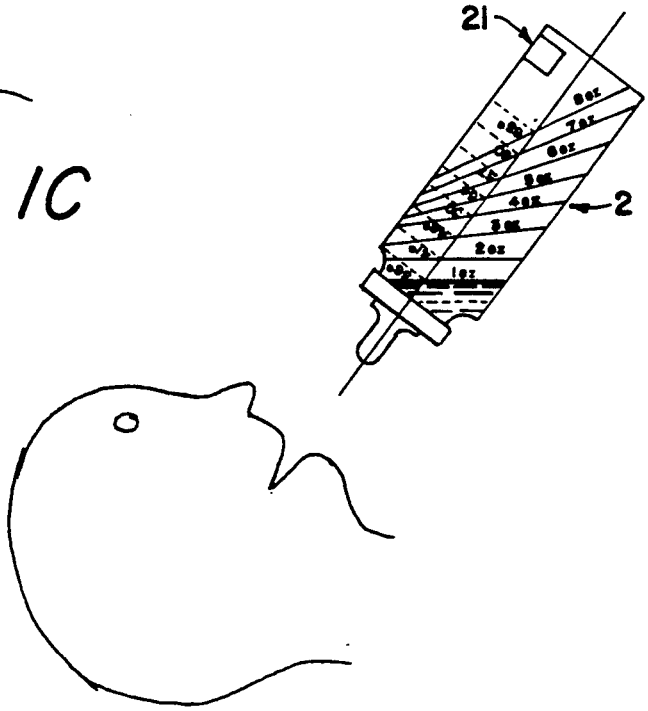

On account of the foregoing construction, it will be appreciated that when the bottle 4 shown in FIGS. 1 and 1A is filled with fluid and then introduced into the baby's mouth to commence feeding (FIG. 1B), with the bottle being held so that its direction marking means 21 face upward and so that its graduated markings 18 are oriented relatively horizontally, graduated markings 18 will provide a reliable measure of fluid content throughout the feeding process. More particularly, it will be seen that as the fluid in the bottle is consumed and the bottle is correspondingly tipped further and further upward toward the vertical (FIGS. 1C and 1D, respectively), the fluid's meniscus will approach nipple 6 with a constantly changing position relative to the bottle, and this changing meniscus position will be closely approximated by the positions of the various graduated markings 18. Thus, the meniscus of the fluid may be quickly and easily read against respective ones of graduated markings 18 so as to provide an easy, convenient and accurate measure of the fluid contained in bottle 4 at any time during feeding.

Figure 2:
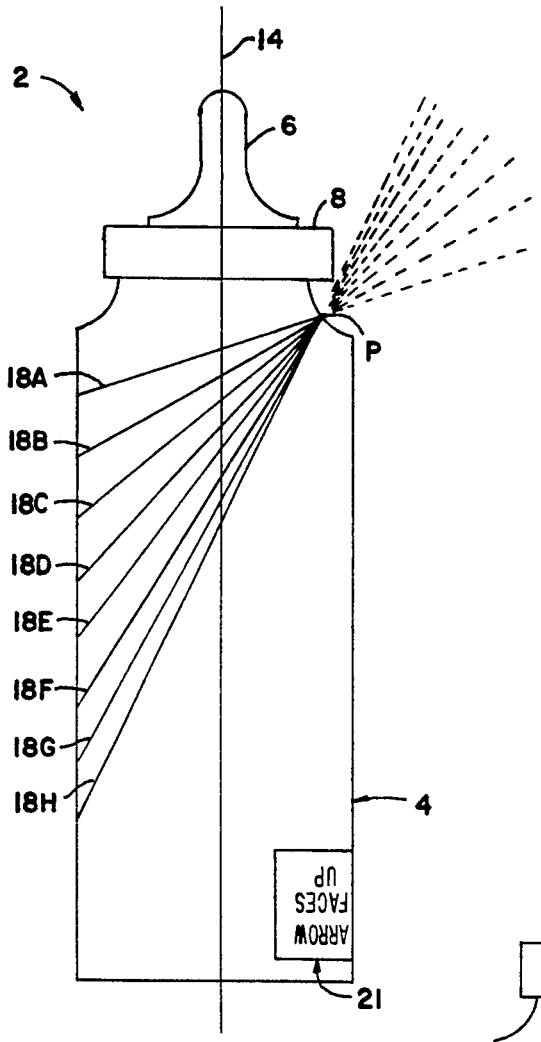
FIG. 2 is a view similar to that of FIG. 1, except that the graduated markings are positioned on the bottle so that the planes containing the graduated markings intersect each other at a common location on the outer surface of the container.
Figure 3:
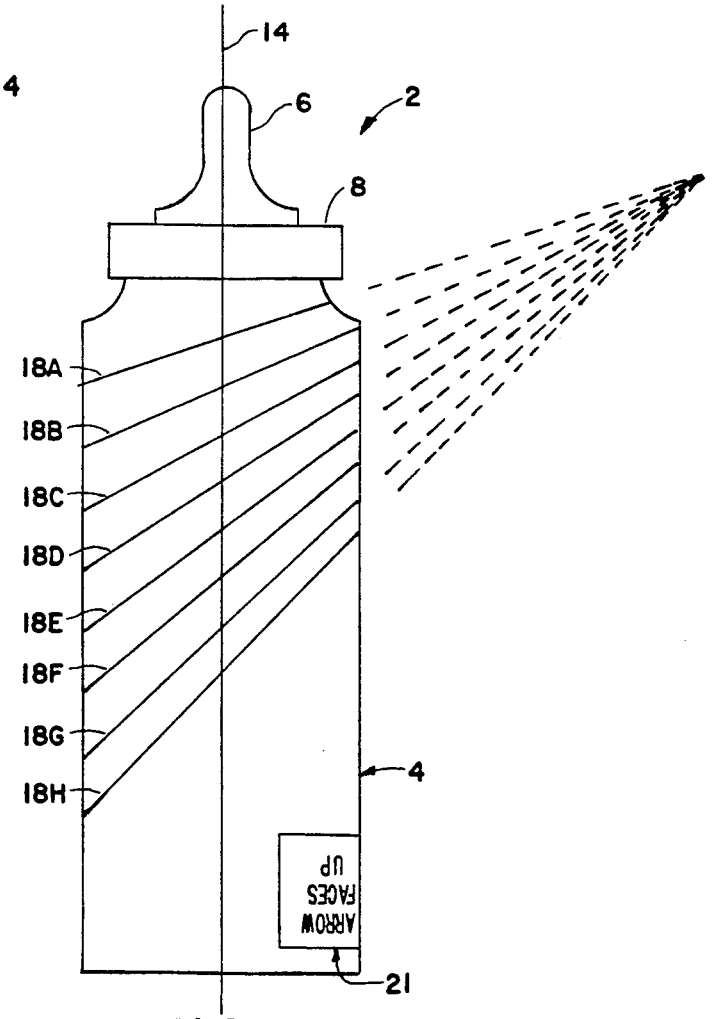
FIG. 3 is a view similar to that of FIG. 2, except that the graduated markings are positioned on the bottle so that the planes containing the graduated markings intersect each other at a common line located at a distance from the container.
Figure 4:
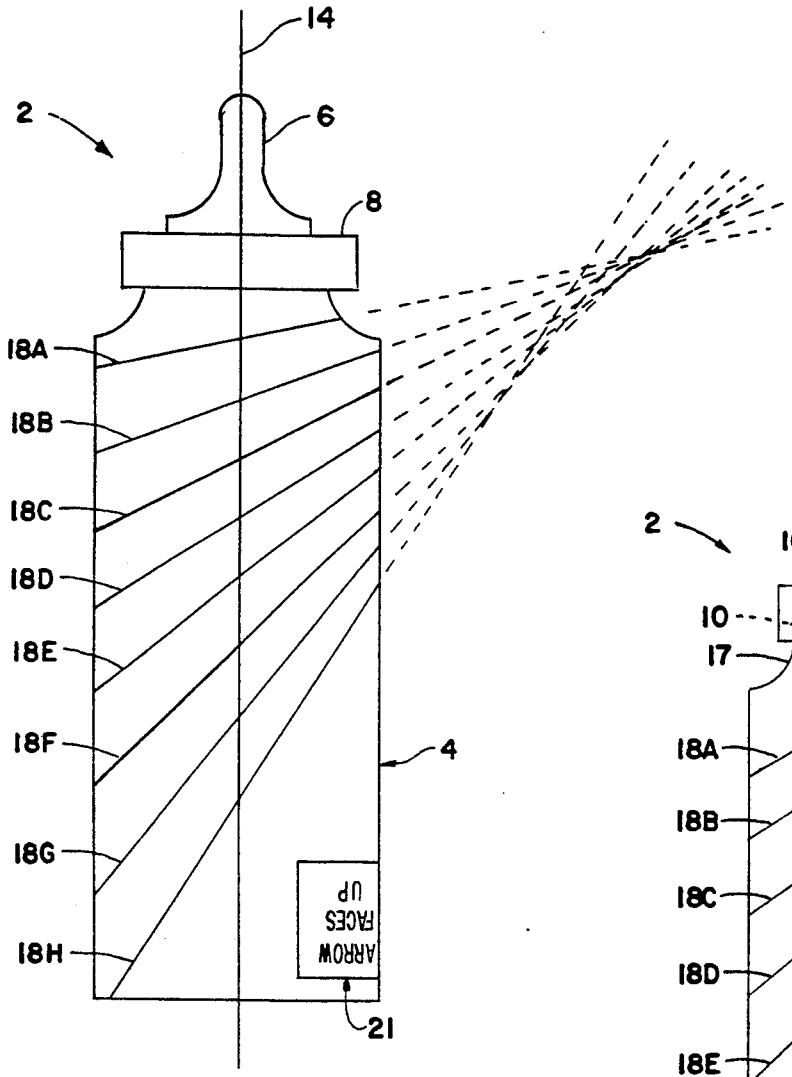
FIG. 4 is a view similar to that of FIG. 1 inasmuch as the planes containing the graduated markings intersect each other at a plurality of parallel lines which are located at a distance from the container, but differs from that of FIG. 1 inasmuch as the graduated markings are not necessarily set at the same angles as the empirically derived markings shown in FIG. 1.
Figure 5:
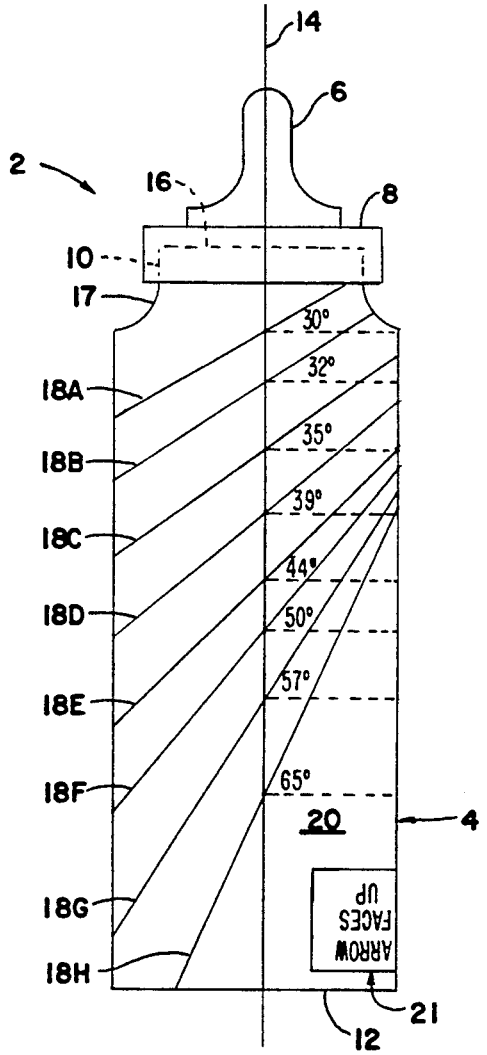
FIG. 5 is an illustrative side elevational view of an infant nursing device made in accordance with the present invention, wherein the degree of progression of the graduated markings increases in a linear fashion along the length of the container.
Figure 6:
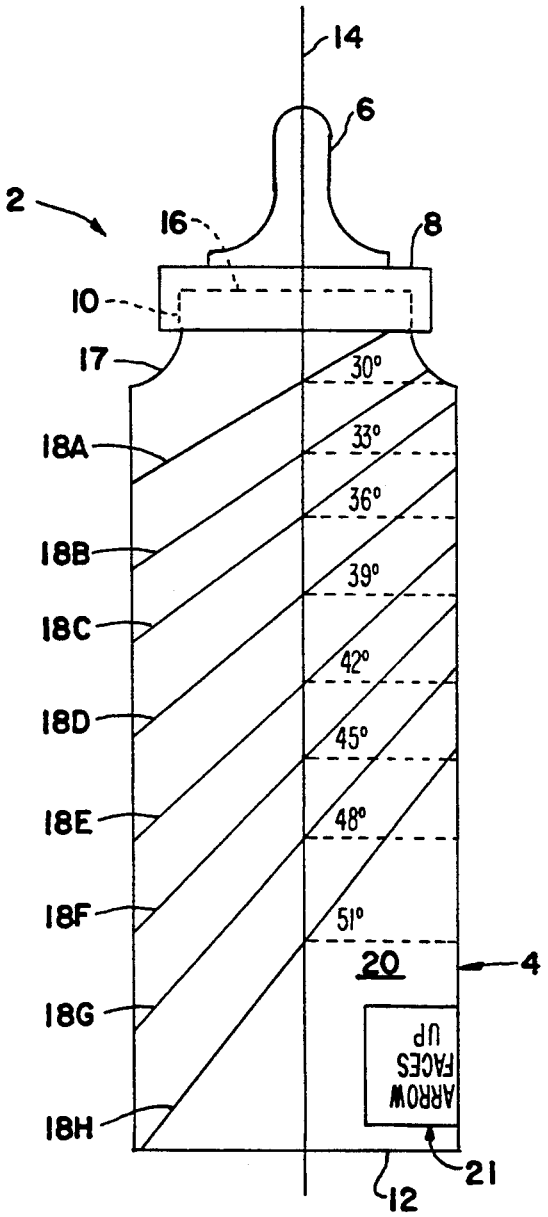
FIG. 6 is an illustrative side elevational view of an infant nursing device made in accordance with the present invention, wherein the degree of progression of the graduated markings is approximately constant throughout the length of the container.

FIGS. 2, 3 and 4 show various alternative configurations for the graduated markings 18A, 18B, 18C, etc., all of which are within the scope of the present invention.

Specifically, in FIG. 2, bottle 4 is identical to the bottle 4 previously discussed, except that the planes defined by the graduated markings 18A, 18B, 18C, etc. intersect each other at a single line which intersects the outer surface of the circular container at a point P. In this respect it will be appreciated that, inasmuch as the nipple should always remain full of fluid during the feeding process, this common point of planar intersection on the bottle (i.e., the location of point P) will be spaced downwardly from the container's open mouth 16. In this way, when bottle 4 is tipped upward so that its top end marking means 21 is elevated in the manner shown in FIGS. 1B–1D and the meniscus of the fluid in bottle 4 is located adjacent point P, the liquid will always completely cover the bottle's mouth 16. It will, of course, also be appreciated that for the embodiment shown in FIG. 2, the angles of the various planes containing graduated markings 18A, 18B, 18C, etc. will be varied somewhat from that shown in FIG. 1 so that the markings will properly reflect the fluid meniscus location for a given fluid volume at the anticipated bottle orientation for that fluid volume.

The embodiment shown in FIG. 3 is similar to the embodiment shown in FIG. 2, except that the graduated markings 18A, 18B, 18C, etc. have been positioned so that their corresponding planes intersect one another at a common point (or, more accurately, a common line) which is positioned outboard of bottle 4.

The embodiment shown in FIG. 4 is similar to the embodiment shown in FIG. 1, but it is not limited to the particular empirically-derived angles and plane separation distances shown in FIG. 1. In this case, the planes containing the graduated markings 18A, 18B, 18C, etc. intersect each other at various lines remote from the container. These planes may, of course, be variously disposed relative to each other and to the container, depending upon the shape of the container and the extent to which its cross-section varies along its height.

It should be appreciated that with all of the embodiments shown in FIGS. 1–4, while the positioning of the graduated marking 18A, 18B, 18C, etc. may vary somewhat relative to one another, in all cases the graduated markings are positioned on bottle 4 such that their respective planes extend non-parallel to one another, and they are positioned on bottle 4 such that the planes of the graduated markings intersect longitudinal axis 14 progressively closer and closer to the perpendicular as they progress toward nipple 6. As noted previously, such a configuration is critical if the graduated markings are to accurately reflect the volume of fluid in the bottle over the full range of different bottle orientations presented during feeding.

Accordingly, it will be understood that so long as the individual feeding the infant is careful to present the nipple to the infant in such a way that direction marking means 21 is positioned face upward and the bottle is tipped so that the opposite end of the nipple is elevated above nipple 6, the amount of liquid remaining in the container can always be easily, conveniently and accurately read directly from the container at any point during the feeding process without removing the bottle from the infant's mouth. It will also be understood that this simplicity, convenience and accuracy is attainable because the orientation of the bottle is substantially the same for most individuals for a given fluid level.

It will also be understood that, inasmuch as graduated markings 18A, 18B, 18C, etc. are disposed on bottle 4 at the angles of inclination naturally selected by most experienced baby feeders, an inexperienced baby feeder will be able to use those markings as a guide during feeding so as to ensure that the proper inclination of the bottle will be maintained, and the nipple kept full of liquid, throughout the feeding process.

Numerous modifications, alterations, variations, combinations and the like will occur to those skilled in the art in view of the foregoing detailed description of the preferred embodiments of this invention.

Figure 7:
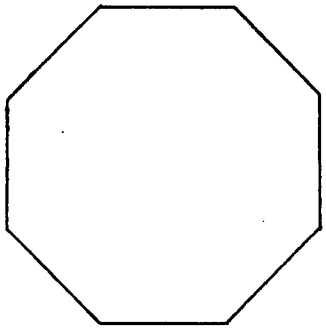
FIG. 7 is an end view of the bottom end of an infant nursing device made in accordance with the present invention, wherein the container has a non-circular cross-section.

Thus, for example, while bottle 4 is described above as having a generally circular cross-section, it could also have a different cross-section, e.g. hexagonal or octagonal or any other non-circular shape. See, for example, FIG. 7, which shows such an octagonal cross-section. In such a case, it will be appreciated that markings 18A, 18B, 18C, etc. will take on a form other than elliptical, e.g. for a bottle having a hexagonal cross-section, markings 18A, 18B, 18C, etc. will assume a corresponding hexagonal shape, and for a bottle having an octagonal cross-section, markings 18A, 18B, 18C, etc. will assume a corresponding octagonal shape. In general, for any bottle having a non-circular cross-section, markings 18A, 18B, 18C, etc. will assume a corresponding shape. Furthermore, it will be appreciated that where bottle 4 has such a non-circular shape, with the embodiment of FIG. 2, the nature of the intersection between the corresponding planes and the bottle, i.e., location P, may change, from that of a single point of intersection for a circular bottle to some other sort of intersection (e.g. a point or a line segment) depending on the cross-sectional shape of the bottle and the particular angle of viewing.

Furthermore, it will be appreciated that in the embodiments shown in FIGS. 1-4, bottle 4 included a narrowed throat or neck section 17, and at least some of the graduated markings 18A, 18B, 18C, etc. may intersect the throat section 17, i.e., markings 18A-18C in FIG. 1, 18A-18H in FIG. 2, 18A and 18B in FIG. 3, and 18A in FIG. 4. Of course, the placement of these markings—indeed, the placement of all of the markings 18A, 18B, 18C, etc.—will take into account the reduced volume of narrowed neck 17 relative to the remainder of the bottle. Of course, bottle 4 may also be formed without a narrowed neck 17, in which case the placement of markings 18A, 18B, 18C, etc. will be adjusted accordingly.

Also, with the embodiments shown in FIGS. 1-4, graduated markings 18 extend entirely around the exterior of bottle 4, e.g. so as to form ellipses on the exterior of the bottle when bottle 4 is in the form of a cylinder. Of course, it is also anticipated that graduated markings 18 might be interupted along part of their length, e.g. graduated markings 18 might be formed by a group of dashes generally following the form of an ellipse on a cylindrically shaped bottle, or graduated markings 18 might extend around only one side of the bottle.

Finally, it should be appreciated that this specification is intended to be illustrative only, and that the invention is limited only by the terms of the claims appended hereto.

What is claimed is:

1. An infant nursing device comprising:

a container adapted for holding liquid, and nipple means;

said container having a top end, a bottom end, a longitudinal axis, and an open mouth at said top end, and further including at least one portion extending from a point adjacent to said open mouth to said bottom end which is non-opaque;

said container having a plurality of graduated markings located on said container in spaced relation to said open mouth, said graduated markings being located respectively in selected non-parallel planes which are (1) normal to a first plane which contains said longitudinal axis, (2) intersect at an acute angle a second plane containing said longitudinal axis and located normal to said first plane, and (3) do not intersect each other within the volume defined by said container;

said non-parallel planes being so selected that they intersect said second plane in a progressive series of angles, with the non-parallel plane associated with the graduated marking nearest said top end of said container intersecting said second plane at an angle closer to the perpendicular than the non-parallel plane associated with the graduated marking nearest said bottom end of said container, and with the planes of the graduated markings disposed therebetween intersecting said second plane progressively closer and closer to the perpendicular as they approach said top end of said container;

said non-parallel planes being so selected that said graduated markings provide indications of liquid remaining in said container as said container is tipped from a partially inverted position toward a fully inverted position during infant feeding; and said nipple means being removably attached to said top end of said container so as to cover and protrude from said open mouth.

2. The device of claim 1 wherein said container is made of transparent material.

3. The device of claim 1 wherein said device is made of translucent material.

4. The device of claim 1 wherein said device further comprises direction marking means for identifying the portion of said container which is to face upward during feeding.

5. The device of claim 1 wherein said graduated markings are located on said container so that the planes of said graduated markings intersect said second plane progressively closer and closer to the perpendicular as they approach said top end of said container, with the degree of progression between adjacent graduated markings increasing as said graduated markings approach said top end.

6. The device of claim 5 wherein said progression increases in a linear fashion along the length of said container.

7. The device of claim 5 wherein said progression increases in a series of discrete steps along the length of said container.

8. The device of claim 1 wherein said graduated markings are located on said container so that the planes of said graduated markings intersect said second plane progressively closer and closer to the perpendicular as they approach said top end of said container, with the degree of progression between adjacent graduated markings being approximately constant throughout the length of said container.

9. The device of claim 1 wherein said container has a round cross-section, and further wherein said non-parallel planes intersect each other at a common point located on the surface of said container.

10. The device of claim 1 wherein said container has a non-circular cross-section, and further wherein said non-parallel planes intersect one another at a common line which intersects the surface of said container.

11. The device of claim 1 wherein said non-parallel planes intersect each other at a common line remote from said container.

12. The device of claim 1 wherein said non-parallel planes intersect each other at a plurality of lines remote from said container.

13. The device of claim 1 wherein said container is a standard infant nursing bottle having a substantially circular cross-section, and wherein said graduated markings are located respectively in eight non-parallel planes.

14. The device of claim 13 wherein said non-parallel planes form angles of approximately 36, 41, 46, 50, 54, 57, 60 and 63 degrees with planes extending perpendicular to said first and second planes, respectively.

15. The device of claim 14 wherein said graduated markings represent the 1 oz, 2 oz, 3 oz, 4 oz, 5 oz, 6 oz, 7 oz and 8 oz fluid levels.

* * * * *